United States Patent [19]

Manaka et al.

[11] Patent Number: 4,905,653

[45] Date of Patent: Mar. 6, 1990

[54] AIR-FUEL RATIO ADAPTIVE CONTROLLING APPARATUS FOR USE IN AN INTERNAL COMBUSTION ENGINE

[75] Inventors: Toshio Manaka, Katsuta; Masami Shida, Mito, both of Japan

[73] Assignee: Hitachi, LTD., Tokyo, Japan

[21] Appl. No.: 296,024

[22] Filed: Jan. 12, 1989

[30] Foreign Application Priority Data

Jan. 18, 1988 [JP] Japan ..... 63-6954

[51] Int. Cl.[4] ..... F02D 41/14; F02M 51/00

[52] U.S. Cl. ..... 123/489; 123/480

[58] Field of Search ..... 123/325, 326, 478, 480, 123/489, 492, 493; 364/431.05

[56] References Cited

U.S. PATENT DOCUMENTS 4,452,212 6/1984 Takase ..... 123/493
4,488,906 6/1984 Sugiyama et al. ..... 123/492
4,667,640 5/1987 Sekozawa et al. ..... 123/480 X
4,790,282 12/1988 Kanno et al. ..... 123/493
4,793,312 12/1988 Doinaga et al. ..... 123/492

*Primary Examiner*—Willis R. Wolfe
*Attorney, Agent, or Firm*—Fay, Sharpe, Beall, Fagan, Minnich & McKee

[57] ABSTRACT

A fuel adhesion percentage of an injected fuel to a surrounding portion of an intake valve is determined in accordance with a fluctuation value of an air-fuel ratio correction coefficient and a fluctuation value of a signal of an air-fuel ratio detecting sensor or a signal of an oxygen amount detecting sensor. Each adhesion percentage of the injected fuel is divided and stored in each division area of a characteristic memory map of a control unit. The adhesion percentage of the injected fuel is stored in a memory of the control unit and is determined in accordance with present throttle valve opening degree and present engine coolant temperature by the characteristic memory map. The adhesion percentage of the injected fuel is obtained through a learning control process in the control unit. An air-fuel ratio correction in a transient period is carried out smoothly.

10 Claims, 6 Drawing Sheets

FIG. 4
| | SMALL → $\theta_{th}$ | | | | LARGE |
|---|---|---|---|---|---|
| LOW | $X_{00}$ | $X_{01}$ | $X_{02}$ | $X_{03}$ | $X_{04}$ |
| ↓ | $X_{10}$ | $X_{11}$ | $X_{12}$ | $X_{13}$ | $X_{14}$ |
| $T_w$ | $X_{20}$ | $X_{21}$ | $X_{22}$ | $X_{23}$ | $X_{24}$ |
| | $X_{30}$ | $X_{31}$ | $X_{32}$ | $X_{33}$ | $X_{34}$ |
| HIGH | $X_{40}$ | $X_{41}$ | $X_{42}$ | $X_{43}$ | $X_{44}$ |
FIG. 5
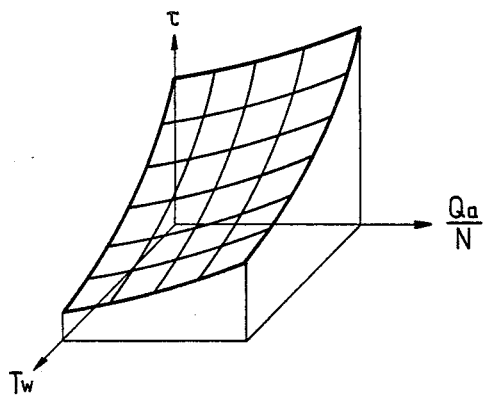
FIG. 6
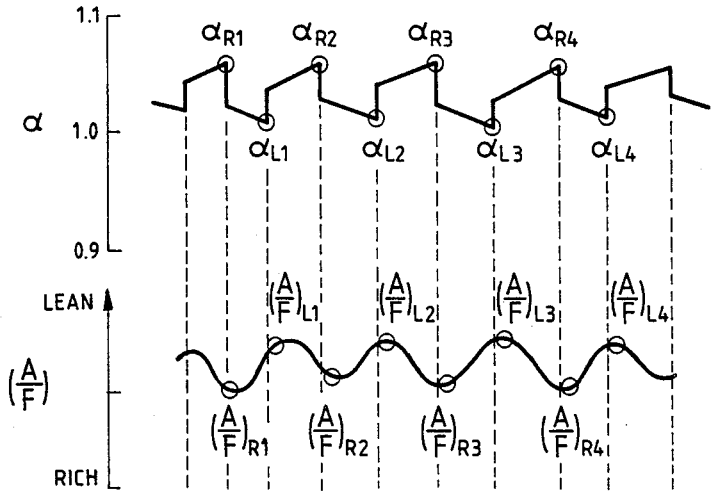

AIR-FUEL RATIO ADAPTIVE CONTROLLING APPARATUS FOR USE IN AN INTERNAL COMBUSTION ENGINE

BACKGROUND OF THE INVENTION

The present invention relates to an air-fuel ratio adaptive controlling apparatus for use in an internal combustion engine and, more particularly to an air-fuel ratio adaptive controlling apparatus for use in a gasoline internal combustion engine suitable for an automobile.

The present invention relates to an air-fuel ratio adaptive controlling apparatus for use in an internal combustion engine wherein an air-fuel mixture being supplied to the internal combustion engine is corrected or compensated during a transient period of an air-fuel ratio (A/F).

Fuel supplied from an injector is injected into an intake pipe of an internal combustion engine and is spread with an angle thereinto. Since the fuel is injected at a surrounding outer surface portion of an intake valve, a part of fuel adheres to the intake valve and an inner wall surface portion of the intake pipe. As a result, the fuel being sucked actually in a cylinder portion of the engine gets fewer. Thereby a misfire fire may occur during an acceleration operation of the engine and an operability of the engine may be damage.

An adhesion percentage or adhesion amount rate of an injected fuel with the intake valve and the intake pipe has a tendency to increase with a time passing change due to the adhesion of carbon or the like to the surrounding outer surface portion of the intake valve, therefore it is necessary to correct the fuel amount for compensating. However in the conventional internal combustion engine there are no considerations about the fuel supply compensation during time passing change caused by the fuel adhesion.

A conventional technique relating to the above mentioned fuel adhesion in an internal combustion engine discloses in, for example U.S. Pat. No. 4,388,906, in which a fuel supply amount compensation during a transient period such as a time at an acceleration operation of an engine is practised in accordance with an adhesion percentage or an adhesion amount rate of an injected fuel and an evaporation characteristic of an adhered fuel.

However, in the above mentioned conventional fuel adhesion technique there are no considerations about a concrete decision for an injected fuel adhesion percentage and an injected fuel adhesion percentage at a time passing change, thereby it gives rate to a problem that an airfuel ratio (A/F) correction at a transient period is not practised satisfactory.

SUMMARY OF THE INVENTION

An object of the present invention is to provide an air-fuel ratio adaptive controlling apparatus for use in an internal combustion engine wherein an air-fuel ratio correction at a transient period can be practised satisfactory.

Another object of the present invention is to provide an air-fuel ratio adaptive controlling apparatus for use in an internal combustion engine wherein an adhesion percentage of an injected fuel can be obtained through a learning control.

A further object of the present invention is to provide an air-fuel ratio adaptive controlling apparatus for use in an internal combustion engine wherein an air-fuel ratio correction can be adapted to a time passing change caused by an accumulation amount of carbon or the like.

A still object of the present invention is to provide an air-fuel ratio adaptive controlling apparatus for use in an internal combustion engine wherein an air-fuel ratio correction at a transient period can be carried out smoothly at any driving time.

Another more object of the present invention is to provide an air-fuel ratio adaptive controlling apparatus wherein a fluctuation of an air-fuel ratio during an acceleration operation period or a deceleration operation period can be corrected or compensated effectively.

A further more object of the present invention is to provide an air-fuel ratio adaptive controlling apparatus wherein a fluctuation of an air-fuel ratio (A/F) during a transient period of an air-fuel ratio (A/F) can be minimized.

According to the present invention, an air-fuel ratio adaptive controlling apparatus for use in an internal combustion engine has a fuel supply means for controlling automatically a supply amount of fuel to an internal combustion engine, in which an amount for affecting to a characteristic of an air-fuel ratio control in the internal combustion engine is detected, the fuel supply amount of the fuel supply means is controlled in accordance with a detected air-fuel ratio control characteristic amount, and an air-fuel ratio detecting means being disposed in an exhaust system in the internal combustion engine, the fuel supply amount of the fuel supply means is corrected in accordance with an adhesion percentage of an injected fuel which adheres to an inner wall surface portion of an intake system in the internal combustion engine and an evaporation characteristic of an adhered fuel.

The adhesion percentage of the injected fuel is determined in accordance with a fluctuation value of the fuel supply amount supplied from the fuel supply means at a point of time in which an output of a detection signal of the air-fuel ratio detecting means is feed-backed and in accordance with a fluctuation value of an actual air-fuel ratio detected from the air-fuel ratio detecting means.

The amount for affecting to the characteristics of air-fuel ratio control comprises at least one of an engine intake air amount, an engine speed, an engine coolant temperature, and an engine load. The engine load comprises at least one of a throttle valve opening degree, a pressure in an intake pipe, and an air amount per one intake air.

The fuel adhesion percentage of the injected fuel is determined in accordance with a fluctuation value of an air-fuel ratio correction coefficient and a fluctuation value of the signal of the air-fuel ratio detecting sensor, and the obtained adhesion percentage of the injected fuel is stored in a memory member of the control unit which corresponds to a division area of a present engine coolant temperature and a present throttle valve opening degree.

The fuel adhesion percentage of the injected fuel is determined in accordance with a fluctuation value of an air-fuel ratio correction coefficient and a fluctuation value of the signal of the oxygen amount detecting sensor, and the obtained adhesion percentage of the injected fuel is stored in a memory member of the control unit which corresponds to a division area of a present engine coolant temperature and a present throttle valve opening degree.

According to the present invention, it is possible to learn a rate of the adhesion amount rate (adhesion percentage) of the injected fuel, therefore an air-fuel ratio (A/F) correction in a transient period of the driving operation can be carried out smoothly. In particular, an air-fuel ratio (A/F) correction according to the present invention can be adapted to the time passing change caused by an accumulation amount of carbon or the like, thereby a suitable air-fuel ratio (A/F) can be obtained at any driving time.

BRIEF DESCRIPTION OF DRAWINGS

FIG. 4 is a characteristic memory map of an adhesion percentage X for an injected fuel according to one embodiment of the present invention;

FIG. 5 is a characteristic map of an evaporation time constant $\tau$ for an adhered fuel according to one embodiment of the present invention;

FIG. 6 is an explanatory view showing a determination method of an adhesion percentage X for an injected fuel using an air-fuel ratio detecting sensor;

DESCRIPTION OF THE INVENTION

Figure 1:
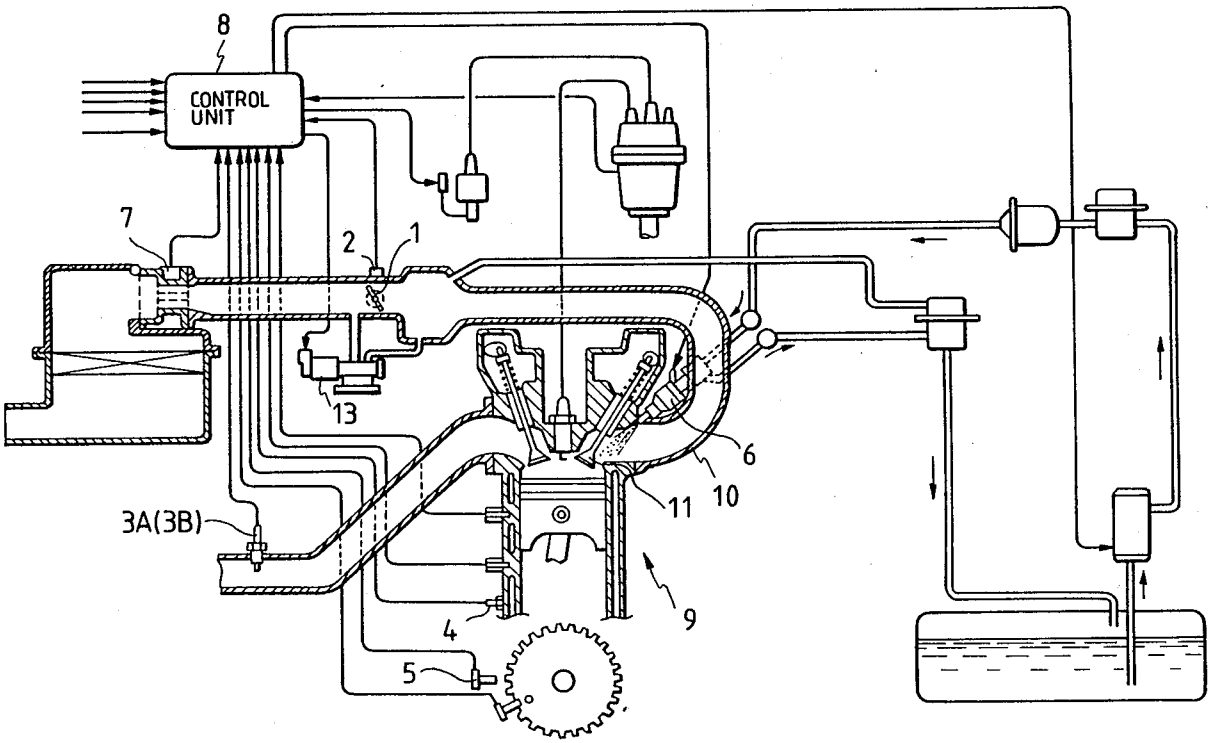
FIG. 1 is a concrete block system view showing a fuel injection system for a gasoline internal combustion engine in which one embodiment of an air-fuel ratio adaptive controlling apparatus for use in a gasoline internal combustion engine according to the present invention is adopted.

One embodiment of an air-fuel ratio adaptive controlling apparatus for use in an internal combustion engine according to the present invention will be explained below in detail referring to the drawings.

FIG. 1 is a block view showing a concrete example of a fuel injection system for a gasoline internal combustion engine in which one embodiment of an air-fuel ratio adaptive controlling apparatus for use in an internal combustion engine according to the present invention is adopted.

An intake air flow amount of a gasoline internal combustion engine 9 is controlled by an opening degree of a throttle valve 1. The throttle valve 1 is controlled by a pedal operating amount of the driver and an actual opening degree $\theta_{th}$ of the throttle valve 1 is detected by a throttle valve opening degree detecting sensor 2. An idle speed control valve 13 adjusts an air flow amount bypassing the throttle valve 1 and controls at a predetermined idle speed.

Besides, an actual intake air flow amount $Q_a$ of the engine 9 is detected by an air flow amount detecting sensor 7. A speed N of the engine 9 is detected by an engine speed detecting sensor 5 and a coolant temperature $T_W$ of the engine 9 is detected by an engine coolant temperature detecting sensor 4, respectively.

A control unit 8 functions mainly as an engine control processor for the engine 9 and has a microprocessor therein as a main member. The control unit 8 takes in various kinds of signals of the actual intake air flow amount $Q_a$, the engine speed N, and the engine coolant temperature $T_W$ or the like through the above stated various sensors and carries out a predetermined execution processing.

The control unit 8 calculates a fuel supply amount for the engine 9 at every moment and works to apply to an injector (fuel injection valve) 6 with a signal in which a fuel supply amount corresponding to the resulting calculated fuel supply amount is obtained. In parallel with this execution processing, the control unit 8 takes in also a signal from an air-fuel ratio detecting sensor 3A (or an oxygen amount detecting sensor 3B), thus a predetermined air-fuel ratio (A/F) control for the engine 9 is maintained.

The air-fuel ratio detecting sensor 3A detects an air-fuel ratio (A/F). When the oxygen amount detecting sensor 3B is used, the oxygen amount detecting sensor 3B detects a rich signal or a lean signal.

The control unit 8 executes a pulse width $T_i$ for injecting fuel to the engine 9 and thereby thus obtained fuel injection pulse width $T_i$ is outputted to the injector 6.

Figure 2:
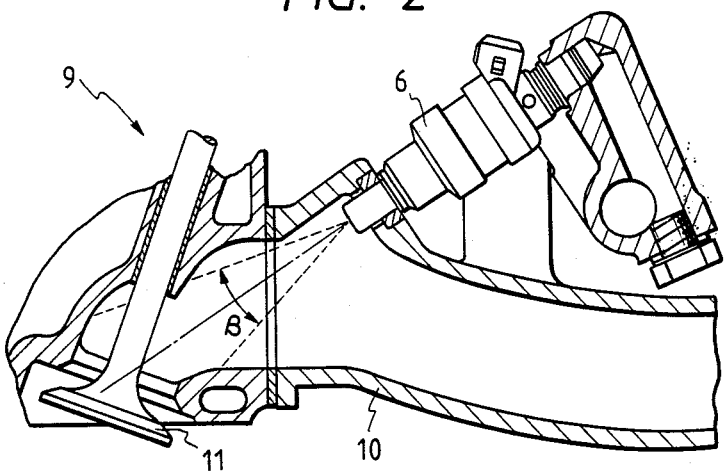
FIG. 2 is a cross-sectional view for showing a surrounding portion including an intake pipe and an intake valve under a fuel injection condition in which the fuel being supplied from an injector is injected into the intake pipe.

Fuel supplied from the injector 6 is injected to an intake pipe 10 of the engine 9 and is spread with an angle $\beta$ thereinto as shown in FIG. 2. Since the fuel is injected to a surrounding outer surface portion of an intake valve 11, a part of fuel adheres to the intake valve 11 and an inner wall surface portion of the intake pipe 10. As a result, the fuel being sucked actually in a cylinder portion of the engine 9 gets fewer.

In this embodiment of the present invention, the engine coolant temperature is represented as an engine temperature, however an intake pipe temperature, an engine oil temperature or the like may be used. Further, the air flow amount $Q_a$ detected by the air flow amount detecting sensor 7 is represented as an air flow amount, however an air flow amount, which estimated from a pressure in the intake pipe 10, the throttle valve opening degree $\theta_{th}$, the engine speed N or the like, may be used.

Next the air-fuel ratio adaptive controlling apparatus which shows the features of the present invention will be explained below in detail.

Figure 3:
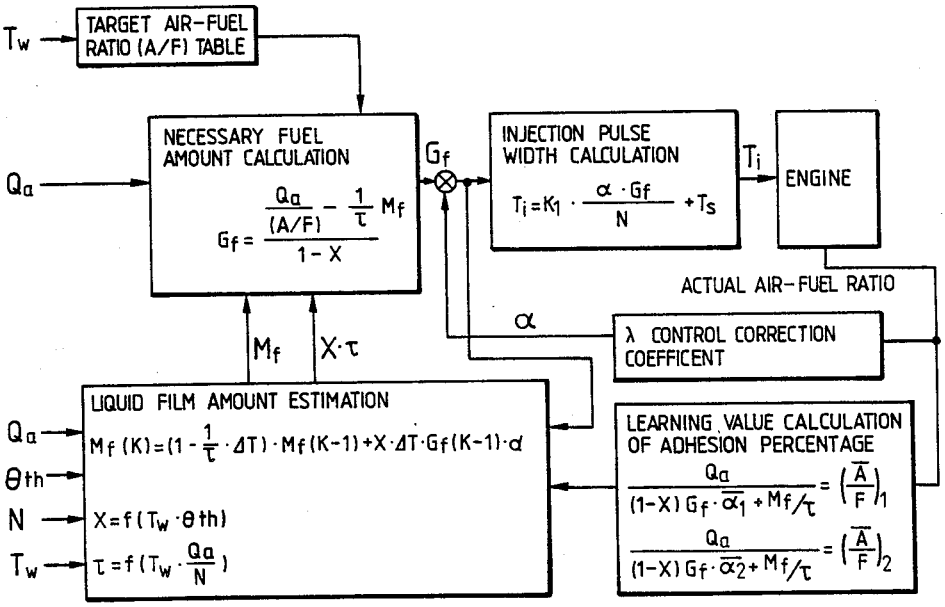
FIG. 3 is a controlling block system view for adaptive controlling an air-fuel ratio (A/F) for use in a gasoline internal combustion engine according to one embodiment of the present invention.

FIG. 3 is a controlling block diagram showing an air-fuel ratio adaptive controlling method according to one embodiment of the present invention. A throttle valve opening degree $\theta_{th}$ for adjusting the actual intake air amount $Q_a$ of the engine 9 is controlled by the driver. As a result, the actual intake air amount $Q_a$, the engine speed N, and the engine coolant temperature $T_W$ are changed according to the throttle valve opening degree $\theta_{th}$.

These values are inputted into the control unit 8, thereby a liquid film amount (an adhesion fuel amount) $M_f$ of the injected fuel, an adhesion percentage X of the injected fuel, and an evaporation time constant $\tau$ of an adhered fuel which evaporates from the liquid film amount $M_f$ are determined by the control unit 8. A necessary fuel supply amount $G_f$ for supplying to the engine 9 is estimated through these values. Finally, an injection pulse width $T_i$ (ms) is outputted to the injector 6.

The air-fuel ratio adaptive controlling method of the present invention will be described below in detail referring to FIG. 3. In FIG. 3, a target air-fuel ratio (A/F) table is stored in the control unit 8.

The liquid film amount $M_f$, which is an adhesion amount of the injected fuel with the inner wall surface portion of the intake pipe 10 or the outer surface portion of the intake valve 11, is estimated in accordance with the following formula.

$$M_f(k) = \left(1 - \frac{1}{\tau} \cdot \Delta T\right) \cdot M_f(k-1) + X \cdot \Delta T \cdot G_f(k-1) \cdot \alpha \quad (1)$$

In the above stated formula, $M_f(k)$ indicates a liquid film amount of a present time, $M_f(k-1)$ indicates a liquid film amount of a previous time, $\tau$ indicates an evaporation time constant of an evaporated fuel being in proportion to the liquid film amount $M_f$, and $\Delta T$ indicates a time difference between the present time and the previous time, namely the time $\Delta T$ =(the present time−the previous time). $G_f(k-1)$ indicates a previous necessary fuel amount for supplying to the engine, and $\alpha$ indicates a correction coefficient of the air-fuel ratio (A/F). $\alpha$ is also a control correction coefficient of an excess air ratio $\lambda$.

The present liquid film amount or the present adhesion fuel amount of the injected fuel $M_f(k)$ is estimated in accordance with the previous liquid film amount or the previous adhesion fuel amount of the injected fuel $M_f(k-1)$ thereby a learning control is carried out.

The necessary fuel supply amount $G_f$ is calculated in accordance with the following formula.

$$G_f = \frac{\frac{Q_a}{(A/F)} - \frac{1}{\tau} M_f}{1 - X} \quad (2)$$

The injection pulse width $T_i$ is calculated in accordance with the following formula.

$$T_i = K_1 \frac{\alpha \cdot G_f}{N} + T_s \quad (3)$$

In the above stated formula, $K_1$ indicates a coefficient, and $T_s$ indicates a correction coefficient of a battery (voltage).

The value of the adhesion percentage X of the injected fuel is calculated in accordance with the following formula.

$$\frac{Q_a}{(1 - X)\, G_f \cdot \alpha_1 + \frac{M_f}{\tau}} = \left(\frac{A}{F}\right)_1 \quad (4)$$

$$\frac{Q_a}{(1 - X)\, G_f \cdot \alpha_2 + \frac{M_f}{\tau}} = \left(\frac{A}{F}\right)_2 \quad (5)$$

In the above stated formula, the values $\overline{\alpha}_1$ and $\overline{\alpha}_2$, and $(\overline{A/F})_1$ and $(\overline{A/F})_2$ are explained in a later portion of the present specification.

Therefore, the value of the adhesion percentage X of the injected fuel is also obtained through a learning process in accordance with the above stated formula. Thus, the learning value calculation about the adhesion percentage X of the injected fuel is carried out in the above stated embodiment of the present invention.

FIG. 4 is a characteristic memory map with respect to the adhesion percentage X of the injected fuel. The adhesion percentage X of the injected fuel, which comprises X00, X01, . . . , and X44, is stored in a RAM (random access memory) of the unit control 8.

Each adhesion percentage X00, X01, . . . , and X44 of the injected fuel is determined in accordance with the throttle valve opening degree $\theta_{th}$ and the engine coolant temperature $T_W$, and is divided and stored in each division area as shown in FIG. 4.

The adhesion percentage X of the injected fuel comprising the adhesion percentages X00, X01, . . . , and X44 is stored in the memory of the control unit 8 corresponding to a division area of the driving area in which the adhesion percentage X of the injected fuel is calculated.

FIG. 5 is a characteristic map with respect to the evaporation time constant $\tau$ of the adhered fuel. The evaporation time constant $\tau$ of the adhered fuel is determined in accordance with a ratio value ($Q_a$/N) of the actual intake air amount $Q_a$ and the engine speed N, and the engine coolant temperature $T_W$.

Therefore, in the above stated embodiment of the present invention, the learning value correction about the adhesion percentage X of the injected fuel is carried out in the control unit 8 using the characteristic map with respect to the adhesion percentage X of the injected fuel shown in FIG. 4 and the characteristic memory map with respect to the characteristic map with respect to the evaporation time constant $\tau$ of the adhered fuel shown in FIG. 5.

FIG. 6 is an explanatory diagram showing an adhesion percentage determination method using the air-fuel ratio detecting sensor 3A according to one embodiment of the present invention.

FIG. 6 shows the fluctuation value of the air-fuel ratio correction coefficient $\alpha$ and the fluctuation value of the air-fuel ratio (A/F) signal.

In FIG. 6, the air-fuel ratio correction coefficient $\alpha$ varies as $\alpha_{R1}$, $\alpha_{R2}$, $\alpha_{R3}$ and $\alpha_{R4}$ in the rich condition of the engine 9 and also $\alpha_{L1}$, $\alpha_{L2}$, $\alpha_{L3}$ and $\alpha_{L4}$ in the lean condition of the engine 9. The fluctuation value of the air-fuel ratio correction coefficient $\alpha$ is in proportion to the fluctuation value of the fuel supply amount to the engine 9.

In case of the air-fuel ratio detecting sensor 3A, the fluctuation value of the air-fuel ratio (A/F) varies as $(A/F)_{R1}$, $(A/F)_{R2}$, $(A/F)_{R3}$, and $(A/F)_{R4}$ in the rich condition of the engine 9 and also $(A/F)_{L1}$, $(A/F)_{L2}$, $(A/F)_{L3}$, and $(A/F)_{L4}$ in the lean condition of the engine 9.

A fuel supply amount $G_{fe}$ for supplying into the cylinder portion of the engine 9 is represented the following formula (6). An actual air-fuel ratio (A/F) is represented the following formula (7).

$$G_{fe} = (1 - X)\, G_f \cdot \alpha + \frac{M_f}{\tau} \quad (6)$$

-continued $$\frac{A}{F} = \frac{Q_a}{G_{fe}} = \frac{Q_a}{(1 - X)\, G_f \cdot \alpha + \frac{M_f}{\tau}} \tag{7}$$

In a normal driving operation, the actual intake air amount $Q_a$, the necessary fuel supply amount $G_f$, and a value $M_f/\tau$ is considered to be substantially constant. The adhesion percentage X of the injected fuel is determined in accordance with next simultaneous equations (8).

$$\begin{cases} \dfrac{Q_a}{(1 - X)\, G_f \cdot \alpha_1 + \frac{M_f}{\tau}} = \left(\dfrac{A}{F}\right)_1 \\ \dfrac{Q_a}{(1 - X)\, G_f \cdot \alpha_2 + \frac{M_f}{\tau}} = \left(\dfrac{A}{F}\right)_2 \end{cases} \tag{8}$$

wherein $$\alpha_1 = (\alpha_{R1} + \alpha_{R2} + \alpha_{R3} + \alpha_{R4}) / 4 \tag{9}$$

$$\alpha_2 = (\alpha_{L1} + \alpha_{L2} + \alpha_{L3} + \alpha_{L4}) / 4$$

$$\begin{cases} \left(\dfrac{A}{F}\right)_1 = \left(\left(\dfrac{A}{F}\right)_{R1} + \left(\dfrac{A}{F}\right)_{R2} + \left(\dfrac{A}{F}\right)_{R3} + \left(\dfrac{A}{F}\right)_{R4}\right)/4 \\ \left(\dfrac{A}{F}\right)_2 = \left(\left(\dfrac{A}{F}\right)_{L1} + \left(\dfrac{A}{F}\right)_{L2} + \left(\dfrac{A}{F}\right)_{L3} + \left(\dfrac{A}{F}\right)_{L4}\right)/4 \end{cases} \tag{10}$$

Figure 7:
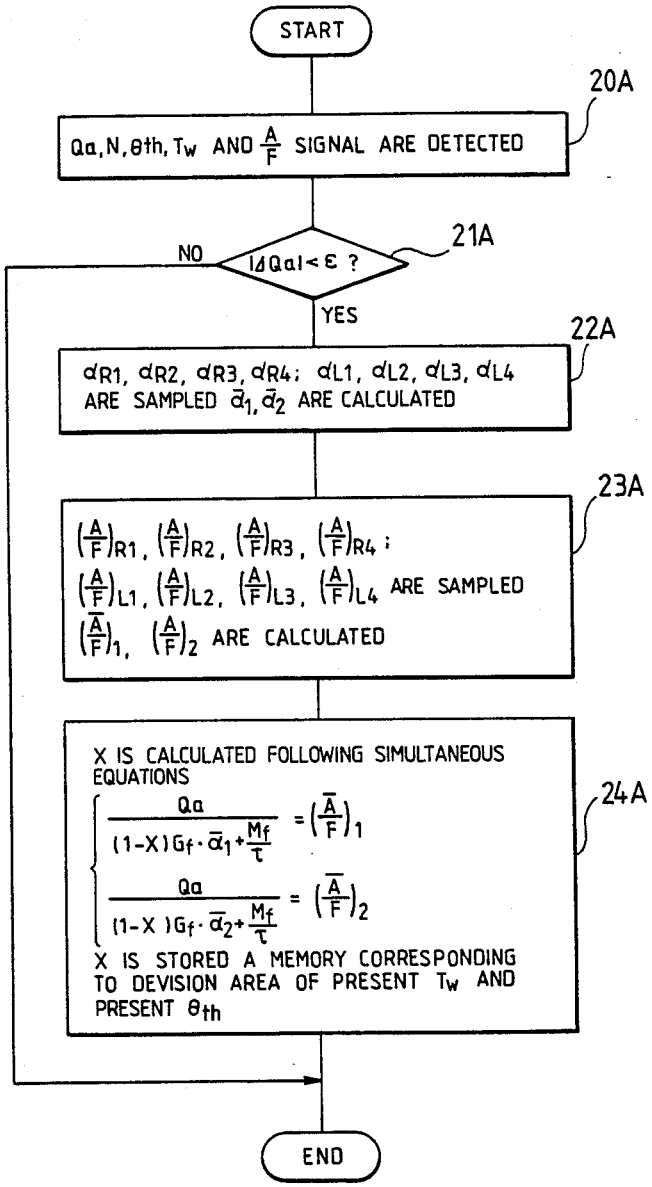
FIG. 7 is a flow-chart diagram for calculating of an adhesion percentage X for an injected fuel using an air-fuel ratio detecting sensor fuel according to one embodiment of the present invention.

FIG. 7 is a flow-chart diagram of the controlling program for the air-fuel ratio adaptive controlling apparatus according to one embodiment of the present invention. In this embodiment, the air-fuel ratio detecting sensor 3A is used therein, and this controlling program is actuated at an every predetermined period.

At first, at a step 20A, the actual intake air amount $Q_a$, the throttle valve opening degree $\theta_{th}$, and an air-fuel ratio (A/F) signal of the air-fuel ratio detecting sensor 3A are detected in accordance with the above stated various sensors.

At a step 21A, the intake air fluctuation amount $\Delta Q_a$ at a predetermined time is determined in accordance with whether or not it is smaller than a predetermined value $\epsilon$. In case the intake air fluctuation amount $\Delta Q_a$ at a predetermined time is smaller than the predetermined value $\epsilon$, or it is "YES", it is regard as to present normal driving condition of the engine 9.

At a step 22A, the sampling of the values about the air-fuel ratio correction coefficient $\alpha_{R1}$, $\alpha_{R2}$, $\alpha_{R3}$, and $\alpha_{R4}$, and also the sampling of the values about the air-fuel ratio correction coefficient $\alpha_{L1}$, $\alpha_{L2}$, $\alpha_{L3}$, and $\alpha_{L4}$ are carried out. Further, the values about average values $\overline{\alpha_1}$ and $\overline{\alpha_2}$ are calculated.

At a step 23A, the sampling of the values about $(A/F)_{R1}$, $(A/F)_{R2}$, $(A/F)_{R3}$, and $(A/F)_{R4}$, and also the sampling of values about $(A/F)_{L1}$, $(A/F)_{L2}$, $(A/F)_{L3}$ and $(A/F)_{L4}$ are carried out. Further, the average values about $\overline{(A/F)}_1$ and $\overline{(A/F)}_2$ are calculated.

At a step 24A, the adhesion percentage X of injected fuel is calculated in accordance with the above stated simultaneously equations (8). The calculated adhesion percentage X of the injected fuel is stored in the division area in the memory of the control unit 8, which corresponds to the present engine coolant temperature $T_W$ and the present throttle valve opening degree $\theta_{th}$.

The adhesion percentage X of the injected fuel is calculated in accordance with the above stated steps 22A, 23A and 24A. The calculated adhesion percentage X of the injected fuel is stored in the memory at the division area of the control unit 8 which corresponds to at a driving area wherein the adhesion percentage X of the injected fuel is calculated.

Figure 8:
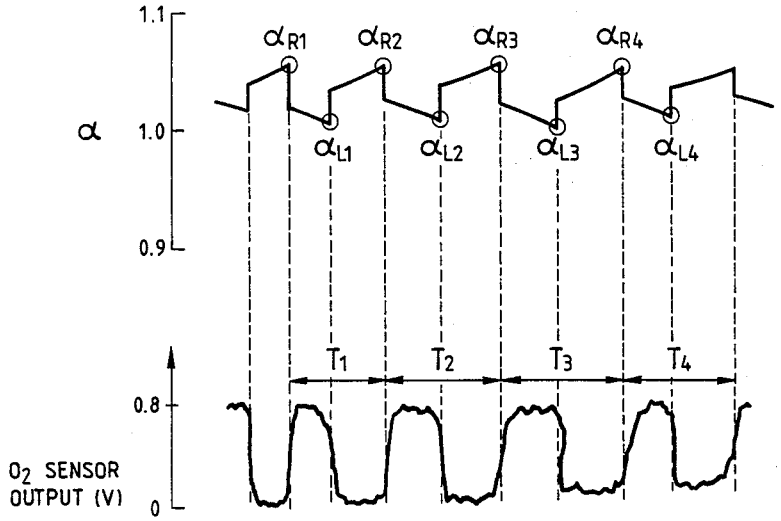
FIG. 8 is an explanatory view showing a determination method of an adhesion percentage X for an injected fuel using an oxygen amount detecting sensor.

FIG. 8 is an explanatory diagram showing an adhesion percentage determination method using the oxygen amount detecting sensor 3B according to another embodiment of the present invention.

FIG. 8 shows a fluctuation value of the air-fuel ratio correction coefficient $\alpha$ and the fluctuation value of the oxygen amount signal which is an output of the oxygen amount detecting sensor 3B.

In FIG. 8, the air-fuel ratio correction coefficient $\alpha$ varies as $\alpha_{R1}$, $\alpha_{R2}$, $\alpha_{R3}$, and $\alpha_{R4}$ in the rich condition of the engine 9 and also $\alpha_{L1}$, $\alpha_{L2}$, $\alpha_{L3}$, and $\alpha_{L4}$ in the lean condition of the engine 9. The fluctuation value of the air-fuel ratio correction coefficient $\alpha$ corresponds to the fluctuation value of the fuel supply amount to the engine 9.

In case of the oxygen amount detecting sensor ($O_2$ sensor) 3B, the fluctuation value of the oxygen amount signal varies $T_1$, $T_2$, $T_3$, and $T_4$ in accordance with the output of the oxygen amount detecting sensor 3B.

Figure 9:
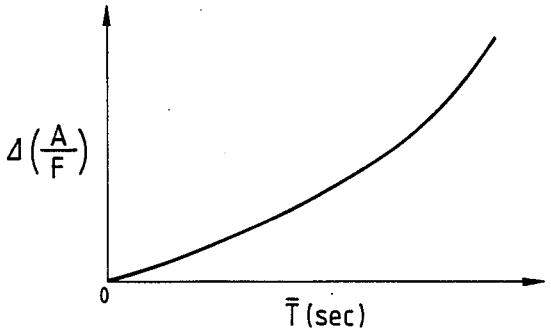
FIG. 9 is a characteristic curve between a fluctuation period and an air-fuel ratio fluctuation width of an oxygen amount detecting sensor.

FIG. 9 is a characteristic relationship curve between the fluctuation period $\overline{T}$ of the oxygen amount detecting sensor 3B and the fluctuation width $\Delta(A/F)$ of the air-fuel ratio.

In case of an oxygen amount detecting sensor 3B is used in replace of the air-fuel ratio detecting sensor 3A, an air-fuel fluctuation width $\Delta(A/F)$ is estimated from an average value $\overline{T}$ of the oxygen amount detecting sensor fluctuation period $\{\overline{T}=(T_1+T_2+T_3+T_4)/4\}$. The adhesion percentage X of the injected fuel is obtained from the following formula in replace of the values $\overline{(A/F)}_1$ and $\overline{(A/F)}_2$ shown in the above stated formula (8).

$$\begin{cases} \left(\dfrac{A}{F}\right)_1 = 14.7 - \dfrac{1}{2} \cdot \Delta\left(\dfrac{A}{F}\right) \\ \left(\dfrac{A}{F}\right)_2 = 14.7 + \dfrac{1}{2} \cdot \Delta\left(\dfrac{A}{F}\right) \end{cases} \tag{11}$$

Figure 10:
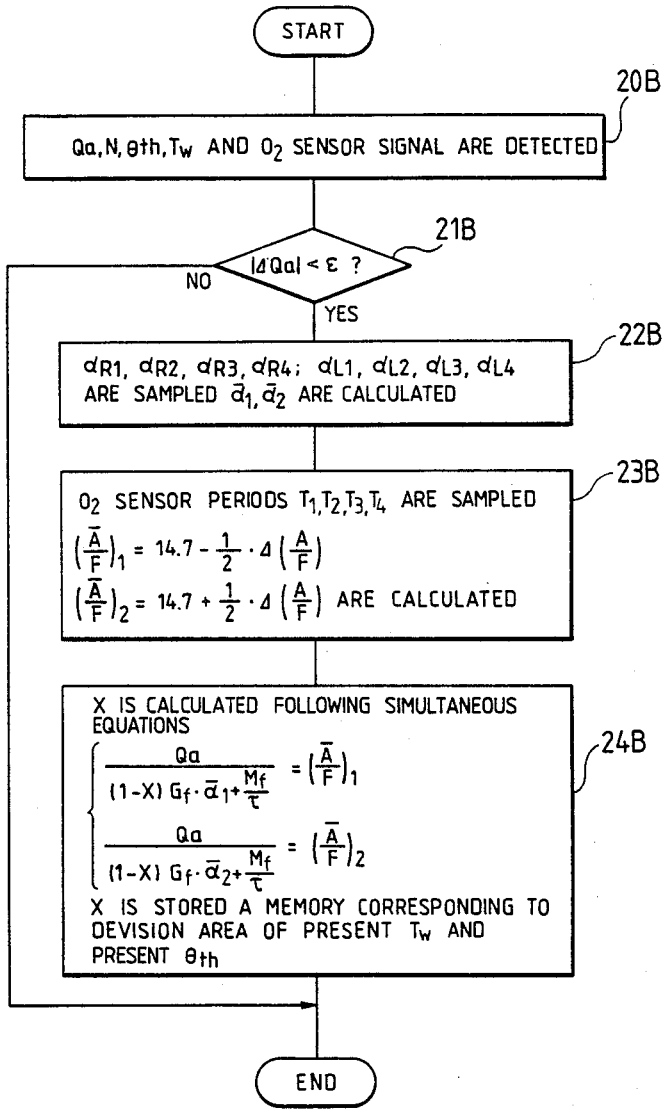
FIG. 10 is a flow-chart diagram for calculating of an adhesion percentage X for an injected fuel using an oxygen amount detecting sensor according to another embodiment of the present invention.

FIG. 10 is a flow-chart diagram of the controlling program for the air-fuel ratio adaptive controlling apparatus according to another embodiment of the present invention. In this embodiment, the oxygen amount detecting sensor ($O_2$ sensor) 3B is used therein, and this controlling program is actuated at an every predetermined period.

At first, at a step 20B, the actual intake air amount $Q_a$, the throttle valve opening degree $\theta_{th}$ and a signal of the oxygen amount detecting sensor 3B are detected in accordance with the above stated various sensors.

At a step 21B, the intake air fluctuation amount $\Delta Q_a$ at a predetermined time is determined in accordance with whether or not it is smaller than a predetermined value $\epsilon$. In case the intake air fluctuation amount $\Delta Q_a$ at a predetermined time is smaller than the predetermined value $\epsilon$, or it is "YES", it is regard as to present normal driving condition of the engine 9.

At a step 22B, the sampling of the values about the air-fuel ratio correction coefficient $\alpha_{R1}$, $\alpha_{R2}$, $\alpha_{R3}$, and $\alpha_{R4}$, and also the sampling of the values about the air-fuel ratio correction coefficient $\alpha_{L1}$, $\alpha_{L2}$, $\alpha_{L3}$, and $\alpha_{L4}$ are carried out. Further, the values about average values $\overline{\alpha}_1$ and $\overline{\alpha}_2$ are calculated.

At a step 23B, the sampling of the values about the period times $T_1$, $T_2$,$T_3$, and $T_4$ of the oxygen amount detecting sensor 3B are carried out. Further, the values about $\overline{(A/F)}_1$ and $\overline{(A/F)}_2$ are calculated in accordance with the characteristic curve between the fluctuation period and the air-fuel ratio fluctuation width shown in FIG. 9.

At a step 24B, the adhesion percentage X of injected fuel is calculated in accordance with the above started simultaneously equations (11). The calculated adhesion percentage X of the injected fuel is stored in the division area in the memory of the controled unit 8, which corresponds to the present engine coolant temperature $T_W$ and the present throttle valve opening degree $\theta_{th}$.

The adhesion percentage X of the injected fuel is calculated in accordance with the above started steps 22B, 23B and 24B. The calculated adhesion percentage X of the injected fuel is stored in the memory at the division area of the control unit 8.

We claim:

1. An air-fuel ratio adaptive controlling apparatus for use in an internal combustion engine having a fuel supply means for controlling automatically a supply amount of fuel to the internal combustion engine, in which an amount for affecting to a characteristic of an air-fuel ratio control in the internal combustion engine is detected, said fuel supply amount of said fuel supply means is controlled in accordance with a detected air-fuel ratio control characteristic amount, and an air-fuel ratio detecting means being disposed in an exhaust system in the internal combustion engine, said fuel supply amount of said fuel supply means is corrected in accordance with an adhesion percentage of an injected fuel which adheres to an inner wall surface portion of an intake system in the internal combustion engine and an evaporation characteristic of an adhered fuel, characterized in that said adhesion percentage of the injected fuel is determined in accordance with a fluctuation value of said fuel supply amount supplied from said fuel supply means at a point of time in which an output of a detection signal of said air-fuel ratio detecting means is fedback and in accordance with a fluctuation value of an actual air-fuel ratio detected from said air-fuel ratio detecting means.

2. An air-fuel ratio adaptive controlling apparatus for use in an internal combustion engine according to claim 1, characterized in that said amount for affecting to the characteristics of air-fuel ratio control comprises at least one of an engine intake air amount, an engine speed, an engine temperature, and an engine load.

3. An air-fuel ratio adaptive controlling apparatus for use in an internal combustion engine according to claim 1, characterized in that said air-fuel ratio detecting means comprises at least one of an air-fuel ratio detecting sensor and an oxygen amount detecting sensor.

4. An air-fuel ratio adaptive controlling apparatus for use in an internal combustion engine according to claim 2, characterized in that said engine load comprises at least one of a throttle valve opening degree, a pressure in an intake pipe, and an air amount per one intake air.

5. An air-fuel ratio adaptive controlling apparatus for use in an internal combustion engine having a fuel supply means for controlling automatically a supply amount of fuel to an internal combustion engine, in which an engine intake air amount, an engine speed, an engine temperature, and a throttle valve opening degree are detected, and an air-fuel ratio detecting sensor being disposed an exhaust system in the internal combustion engine, a control unit for inputting the engine intake air amount, the engine speed, the engine temperature, and the throttle valve opening degree, said fuel supply amount of said fuel supply means is controlled in accordance with a detected engine intake air amount, a detected engine speed, a detected engine temperature, a detected throttle valve opening degree, and a detected signal of said air-fuel ratio detecting sensor, said fuel supply amount of said fuel supply means is corrected in accordance with an adhesion percentage of an injected fuel which adheres to an inner wall surface portion of an intake system of the internal combustion engine and an evaporation characteristic of an adhered fuel, characterized in that said fuel adhesion percentage of the injected fuel is determined in accordance with a fluctuation value of an air-fuel ratio correction coefficient and a fluctuation value of said signal of said air-fuel ratio detecting sensor, and said obtained adhesion percentage of the injected fuel is stored in a memory member of said control unit which corresponds to a division area of a present engine temperature and a present throttle valve opening degree.

6. An air-fuel ratio adaptive controlling apparatus for use in an internal combustion engine having a fuel supply means for controlling automatically a supply amount of fuel to an internal combustion engine, in which an engine intake air amount, an engine speed, an engine temperature, and a throttle valve opening degree are detected, and an oxygen amount detecting sensor being disposed an exhaust system in the internal combustion engine, a control unit for inputting the engine intake air amount, the engine speed, the engine temperature, and the throttle valve opening degree, said fuel supply amount of said fuel supply means is controlled in accordance with a detected engine intake air amount, a detected engine speed, a detected engine temperature, a detected throttle valve opening degree, and a detected signal of said oxygen amount detecting sensor, said fuel supply amount of said fuel supply means is corrected in accordance with an adhesion percentage of an injected fuel which adheres to an inner wall surface portion of an intake system of the internal combustion engine and an evaporation characteristic of an adhered fuel, characterized in that said fuel adhesion percentage of the injected fuel is determined in accordance with a fluctuation value of an air-fuel ratio correction coefficient and a fluctuation value of said signal of said oxygen amount detecting sensor, and said obtained adhesion percentage of the injected fuel is stored in a memory member of said control unit which corresponds to a division area of a present engine temperature and a present throttle valve opening degree.

7. An air-fuel ratio adaptive controlling apparatus for use in an internal combustion engine having a fuel supply means for controlling automatically a supply amount of fuel to an internal combustion engine, in which an engine intake air amount, an engine speed, an engine coolant temperature, and a throttle valve opening degree are detected, and an air-fuel ratio detecting sensor being disposed an exhaust system in the internal combustion engine, a control unit for inputting the engine air intake amount, the engine speed, the engine coolant temperature, and the throttle valve opening degree, said fuel supply amount of said fuel supply means is controlled in accordance with a detected engine air intake amount, a detected engine speed, a detected engine coolant temperature, a detected throttle valve opening degree, and a detected signal of said air-fuel ratio detecting sensor, said fuel supply amount of said fuel supply means is corrected in accordance with an adhesion percentage of an injected fuel which adheres to an inner wall surface portion of an intake system of the internal combustion engine and an evaporation characteristic of an adhered fuel, characterized in that said fuel adhesion percentage of the injected fuel is determined in accordance with whether or not a fluctuation value of the engine intake air amount of a predetermined time is smaller than a predetermined value, when said fluctuation value of the engine intake air amount at the predetermined time is smaller than said predetermined value, an air-fuel ratio correction coefficient is sampled and a mean value of said air-fuel ratio correction coefficient is calculated, and an air-fuel ratio is sampled and a mean value of said air-fuel ratio is calculated, said adhesion percentage of the injected fuel is calculated in said control unit in accordance with a fluctuation value of the air-fuel ratio correction coefficient and a fluctuation value of said signal of said air-fuel ratio detecting sensor, and said obtained adhesion percentage of the injected fuel is stored in a memory member of said control unit which corresponds to a division area of a present engine coolant temperature and a present throttle valve opening degree.

8. An air-fuel ratio adaptive controlling apparatus for use in an internal combustion engine according to claim 7, characterized in that said adhesion percentage of the injected fuel is calculated in said control unit in accordance with following simultaneous equations, $$\frac{Q_a}{(1-X)\,G_f\cdot\alpha_1+\frac{M_f}{\tau}}=\left(\frac{A}{F}\right)_1$$

$$\frac{Q_a}{(1-X)\,G_f\cdot\alpha_2+\frac{M_f}{\tau}}=\left(\frac{A}{F}\right)_2$$

wherein X is an adhesion percentage of the injected fuel, (A/F) a mean value of air-fuel ratio, $Q_a$ an engine intake air amount, $G_f$ a necessary fuel supply amount, $\alpha$ an air-fuel ratio correction coefficient, $M_f$ a liquid film amount, and $\tau$ an evaporation time constant of the adhered fuel.

9. An air-fuel ratio adaptive controlling apparatus for use in an internal combustion engine having a fuel supply means for controlling automatically a supply amount of fuel to an internal combustion engine, in which an engine intake air amount, an engine speed, an engine coolant temperature, and a throttle valve opening degree are detected, and an oxygen amount detecting sensor being disposed an exhaust system in the internal combustion engine, a control unit for inputting the engine intake air amount, the engine speed, the engine coolant temperature, and the throttle valve opening degree, said fuel supply amount of said fuel supply means is controlled in accordance with a detected engine intake air amount, a detected engine speed, a detected engine coolant temperature, a detected throttle valve opening degree, and a detected signal of said oxygen amount detecting sensor, said fuel supply amount of said fuel supply means is corrected in accordance with an adhesion percentage of an injected fuel which adheres to an inner wall surface portion of an intake system of the internal combustion engine and an evaporation characteristic of an adhered fuel, characterized in that said fuel adhesion percentage of the injected fuel is determined in accordance with whether or not a fluctuation value of the engine intake air amount of a predetermined time is smaller than a predetermined value, when said fluctuation value of the engine intake air amount at the predetermined time is smaller than said predetermined value, an air-fuel ratio correction coefficient is sampled and a mean value of said air-fuel ratio correction coefficient is calculated, and a period of said oxygen amount detecting sensor is sampled and a mean value of said air-fuel ratio is calculated, said adhesion percentage of the injected fuel is calculated in said control unit in accordance with a fluctuation value of the air-fuel ratio correction coefficient and a fluctuation value of said signal of said oxygen amount detecting sensor, said obtained adhesion percentage of the injected fuel is stored in a memory member of said control unit which corresponds to a division area of a present engine coolant temperature and a present throttle valve opening degree.

10. An air-fuel ratio adaptive controlling apparatus for use in an internal combustion engine according to claim 9, characterized in that said adhesion percentage of the injected fuel is calculated in said control unit in accordance with following simultaneous equations, $$\frac{Q_a}{(1-X)\,G_f\cdot\alpha_1+\frac{M_f}{\tau}}=\left(\frac{A}{F}\right)_1$$

$$\frac{Q_a}{(1-X)\,G_f\cdot\alpha_2+\frac{M_f}{\tau}}=\left(\frac{A}{F}\right)_2$$

wherein X is an adhesion percentage of the injected fuel, (A/F) a mean value of air-fuel ratio, $Q_a$ an engine intake air amount, $G_f$ a necessary fuel supply amount, $\alpha$ an air-fuel ratio correction coefficient, $M_f$ a liquid film amount, and $\tau$ an evaporation time constant of the adhered fuel.

* * * * *